US006679024B2

(12) United States Patent
Dahl

(10) Patent No.: US 6,679,024 B2
(45) Date of Patent: Jan. 20, 2004

(54) HIGH STRENGTH GROUTED PIPE COUPLER

(76) Inventor: Kjell L. Dahl, 919 Bayside Dr., Newport Beach, CA (US) 92660

( * ) Notice: Subject to any disclaimer, the term of this patent is extended or adjusted under 35 U.S.C. 154(b) by 61 days.

(21) Appl. No.: 10/082,887

(22) Filed: Feb. 26, 2002

(65) Prior Publication Data

US 2003/0159395 A1 Aug. 28, 2003

(51) Int. Cl.[7] ..... E04C 3/30; E04C 5/16

(52) U.S. Cl. ..... 52/726.1; 52/740.7; 52/740.1; 52/583.1; 403/265; 403/305; 29/437

(58) Field of Search ..... 52/740.1, 740.7, 52/726.1, 730.2, 223.8, 853.1; 403/265, 356, 362, 305; 29/437

(56) References Cited

U.S. PATENT DOCUMENTS

| | | | | | |
|---|---|---|---|---|---|
| 2,490,809 | A | * | 12/1949 | Holke | 403/284 |
| 3,552,787 | A | * | 1/1971 | Yee | 403/265 |
| 4,342,981 | A | * | 8/1982 | Yagher, Jr. | 403/267 |
| 4,627,212 | A | * | 12/1986 | Yee | 52/726.1 |
| 4,666,326 | A | * | 5/1987 | Hope | 403/13 |
| 5,230,191 | A | * | 7/1993 | Mayrand | 52/309.12 |
| 5,366,672 | A | * | 11/1994 | Albrigo et al. | 264/35 |
| 5,468,524 | A | * | 11/1995 | Albrigo et al. | 428/34.1 |
| 5,606,839 | A | * | 3/1997 | Baumann | 52/726.1 |
| 5,909,980 | A | * | 6/1999 | Holdsworth | 403/362 |
| 5,974,761 | A | * | 11/1999 | Mochizuki et al. | 52/740.1 |

FOREIGN PATENT DOCUMENTS

| | | | |
|---|---|---|---|
| GB | 2034857 | * | 6/1980 |

* cited by examiner

*Primary Examiner*—Winnie S. Yip
(74) *Attorney, Agent, or Firm*—Morland C. Fischer

(57) ABSTRACT

A high strength grouted pipe coupler by which either a pair of spaced, axially aligned steel reinforcement bars (i.e. rebars) are reliably spliced to one another or a single reinforcement bar is spliced to a flat steel plate to form a T-headed bar configuration. The reinforcement bars are surrounded by a spiral reinforcing spring within a hollow cylindrical sleeve or tube. The coupler tube is filled with an epoxy or cement based grout within which the reinforcement bars and the reinforcing spring are embedded. Set screws are moved through the coupler tube to maintain the position of the reinforcement bars prior to the coupler tube being filled with epoxy or cement. The pipe coupler herein disclosed has application for connecting together contiguous columns, walls, beams and similar structures to enable buildings, parking garages, bridges, subways and airports to be better able to survive a seismic event.

12 Claims, 2 Drawing Sheets

HIGH STRENGTH GROUTED PIPE COUPLER

BACKGROUND OF THE INVENTION

1. Field of the Invention

This invention relates to a high strength grouted pipe coupler by which either a pair of spaced, axially aligned steel reinforcing bars (i.e. rebars) are reliably spliced to one another or a single reinforcement bar is reliably anchored to a flat steel plate to form a T-headed bar configuration for the purpose of connecting together and providing continuous support for precast or cast-in-place concrete structures to be better able to withstand a seismic event.

2. Background Art

It is common in the construction industry, during the erection and retrofitting of buildings, parking structures, bridges, subways, airports, etc., to add a new contiguous concrete structure to an existing concrete structure. Care must be taken during construction to ensure that the contiguous structures are interconnected so that they will not shift relative to one another, particularly as a consequence of a seismic event. The foregoing has been reliably accomplished by the high strength grouted pipe coupler described in my earlier U.S. Pat. No. 6,192,647 issued Feb. 27, 2001. The pipe coupler therein disclosed splices together a pair of reinforcement bars that are axially aligned one above the other within a cylindrical pipe or tube. The opposing ends of the pair of axially aligned reinforcement bars that are surrounded by the coupler tube are headed. That is, each reinforcement bar has a relatively wide upset heard formed at an end thereof. One of the upset heads is mated to a threaded collar. The threaded collar is, in turn, mated to the coupler tube at a threaded interior portion thereof.

The relatively wide upset heads of the pair of reinforcement bars to be spliced together necessities that the coupler tube have a relatively large diameter. Accordingly, a relatively large amount of cement grout is required to fill the coupler tube to form a solid core within which the reinforcement bars will be embedded. In addition to the formation of the upset heads, the threaded collar and the threaded portion of the coupler tube to which the collar is mated increases manufacturing costs and time, particularly in cases where a large number of reinforcement bar couplers are needed at a job site. Therefore, it would be desirable to be able to manufacture a reliable high strength pipe coupler like that described in my U.S. Pat. No. 6,192,647, but which is more compact in construction, is less costly to manufacture, and requires less grout to fill.

SUMMARY OF THE INVENTION

According to a first embodiment of this invention, a high strength grouted pipe coupler is disclosed by which pairs of spaced, axially aligned steel reinforcement bars (i.e. rebars) are spliced to one another for connecting together contiguous precast and cast-in-place columns walls, beams, etc. during the construction or retrofitting of a building, parking garage, bridge, subway, airport, or the like. A concrete structure has a first reinforcement bar embedded therewithin and projecting outwardly therefrom. A cylindrical steel sleeve or tube is positioned around the free end of the first reinforcement bar. A second reinforcement bar is inserted through the top of the coupler tube so as to be positioned in vertical axial alignment with the first bar. A spirally wound reinforcing spring is disposed in a bore between the first and second axially aligned reinforcement bars and the coupler tube for surrounding the opposing ends of the reinforcement bars to be spliced together. A removable stopper pin is then inserted through an inlet opening in the coupler tube so as to extend between the opposing ends of the first and second axially aligned reinforcement bars to establish a gap therebetween. Next, a pair of set screws are inserted through screw holes formed in the top and bottom ends of the coupler tube in order to maintain the positions of the pair of reinforcement bars. With the set screws moved into locking engagement with respective reinforcing bars, the stopper pin is removed, and a supply of epoxy or cement based grout fills the coupler bore via the inlet opening from which the stopper pin has been removed. When the epoxy or grout hardens, a solid core is formed at the interior of the coupler tube by which to reliably couple the pair of reinforcement bars in spaced end-to-end vertical alignment.

According to a second embodiment of this invention, a cylindrical sleeve or tube is affixed (e.g. friction welded) to a flat steel plate. A single reinforcement bar is inserted through the coupler tube so as to rest against the flat plate. A spirally wound reinforcing spring is disposed in a bore between the reinforcement bar and the coupler tube so as to surround the bar to be coupled to the plate. The reinforcement bar is then lifted a short distance off the plate and a set screw is inserted through a screw hole formed in the top end of the coupler tube in order to maintain the position of the reinforcement bar relative to the plate lying therebelow. With the set screw moved into locking engagement with the reinforcement bar, a supply of epoxy or cement based grout fills the coupler bore via an inlet opening at the bottom end of the coupler tube. When the epoxy or grout hardens, a solid core is formed at the interior of the coupler tube to reliably couple the single reinforcement bar in spaced alignment to the flat plate to create a high performance T-headed bar.

DETAILED DESCRIPTION

Figure 1A:
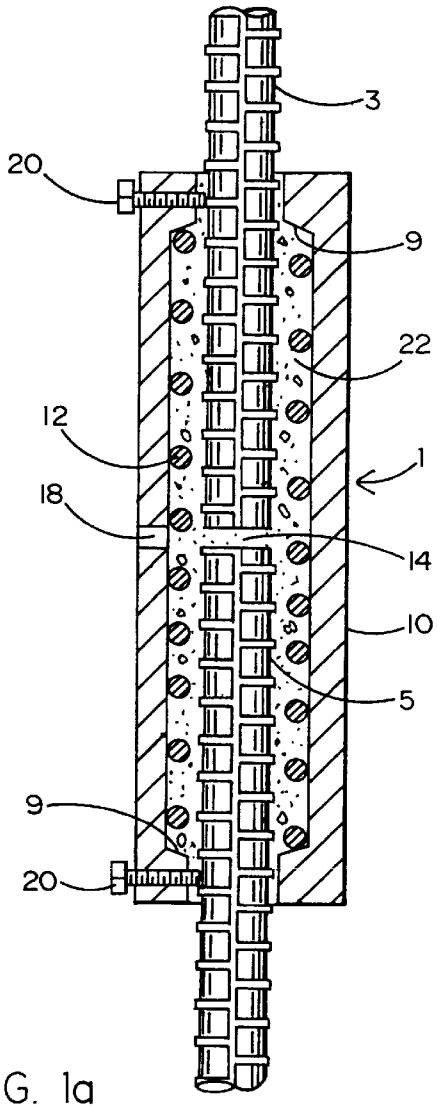
FIG. 1*a* shows the pipe coupler of FIG. 1 with the pair of reinforcement bars embedded in a solid core of concrete or cement based grout.
Figure 1:
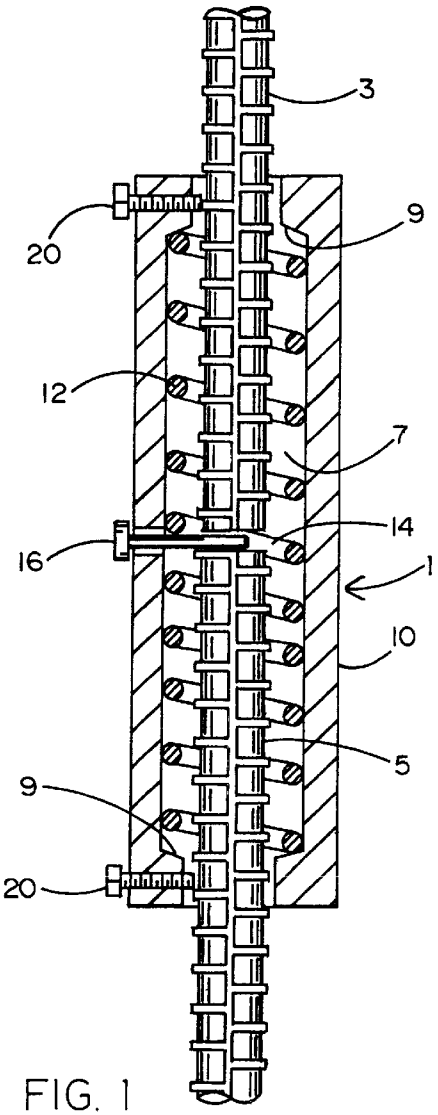
FIG. 1 shows a high strength pipe coupler according to a first embodiment of this invention for mechanically splicing a pair of steel reinforcement bars.

Referring initially to FIG. 1 of the drawings, there is shown a pipe coupler 1 according to a first embodiment of this invention for mechanically splicing and providing continuous support for a pair of standard steel reinforcement bars (i.e. rebars) 3 and 5 that are aligned end-to-end one another to eventually be embedded in concrete. The pipe coupler 1 includes a cylindrical steel sleeve or tube 10 for surrounding the opposing ends of the reinforcement bars 3 and 5 that are to be coupled together. The coupler tube 10 has a length equal to about twenty times the diameter of the bars 3 and 5. The diameter of the coupler tube 10 must be sufficiently large to establish a small bore 7 between the reinforcement bars 3 and 5 and the interior wall of coupler tube 10. The coupler tube 10 includes a seat 9 located at each of the top and bottom ends thereof that extends radially inward of the bore 7.

Located within the bore 7 of coupler tube 10 and surrounding the opposing ends of the pair of reinforcement bars 3 and 5 is a spirally wound reinforcing spring 12. Opposite ends of the reinforcing spring 12 are supported against respective inwardly projecting seats 9 at opposite ends of the coupler tube 10. The reinforcing spring 12 is preferably manufactured from a stiff steel wire. It is important during the manufacture of the pipe coupler 1 of FIG. 1 that the spirally wound reinforcing spring 12 rest freely within the bore 7 between bars 3 and 5 and the coupler tube 10. That is to say, the reinforcing spring 12 is not attached to either of the reinforcement bars 3 and 5 or to the coupler tube 10, whereby spring 12 is free to move within the bore 7. The spirally wound reinforcing spring 12 acts to provide reinforcement for a soon to be described solid core (designated 22 in FIG. 1*a*).

During assembly of the pipe coupler 1, the reinforcement bars 3 and 5 are arranged in spaced axial alignment with one another surrounded by the coupler tube 10, such that a gap 14 (best shown in FIG. 1*a*) is formed between the opposing ends thereof. To maintain the aforementioned gap 14, a removable stopper pin 16 is inserted between the opposing ends of bars 3 and 5 by way of an inlet opening 18 (also best shown in FIG. 1*a*) through coupler tube 10. The stopper pin 16 also functions as a reference to ensure that the top-most reinforcement bar 3 is initially fully inserted within the coupler tube 10 to lie against the bottom-most reinforcement bar 5. To preserve the spaced alignment of the axially aligned reinforcement bar 3 and 5 following the insertion of stopper pin 16, upper and lower set screws 20 are moved into locking engagement with the upper and lower bars 3 and 5 through respective screw holes which are formed in the top and bottom ends of the coupler tube 10 so as to extend through seats 9. Once the reinforcement bars 3 and 5 are secured in spaced vertical alignment with one another by means of set screws 20, the stopper pin 16 is withdrawn from the inlet opening 18 and removed from pipe coupler 1.

Turning now to FIG. 1*a* of the drawings, the bore 7 of pipe coupler 1 is loaded with a solidifier 22 such as an epoxy, a cement based grout, or the like. The pipe coupler 1 is loaded with solidifier 22 via the inlet opening 18 through the coupler tube 10 that was previously occupied by the removable stopper pin 16 shown in FIG. 1. By way of example only, the solidifier 22 with which the pipe coupler 1 is loaded is Set 22 epoxy manufactured by Simpson Strong Tie. As the solidifier cures, the set screws 20 can be removed from the coupler tube 10.

When the solidifier 22 fully hardens to form a solid core, the axially aligned reinforcement bars 3 and 5 will be coupled one above the other, whereby pipe coupler 1 creates a reliable high performance mechanical splice. By virtue of the spiral reinforcing spring 12 that is embedded in the solidifier core 22 within coupler tube 10, the stresses that are applied to the reinforcement bars 3 and 5 during a seismic event are more uniformly spread out along the length of the bars. Moreover, the reinforcing spring 12 helps to anchor the solidifier core 22 within the confines of the coupler tube 10 in response to the tension and compression forces to be applied to the reinforcement bars 3 and 5. Accordingly, the pipe coupler 1 of FIG. 1*a* develops a load capacity substantially equal to that of the reinforcement bars 3 and 5. Nevertheless, the pipe coupler 1 may be designed to break apart under a predetermined seismic load in order to meet the requirements of uniform building codes.

The high strength rebar coupler 1 of FIG. 1*a* can be used for both cast-in-place and precast concrete applications. In particular, the mechanical coupler (i.e. rebar splice) of this embodiment has specific application where the repair and/or retrofit of existing reinforcement bars is required (e.g. during the repair of concrete buildings or structures where previously used reinforcement bars are exposed). In addition, the pipe coupler 1 can also be used for the purpose of connecting together and providing continuous support for contiguous columns, walls, beams, and the like, to enable buildings, parking garages, bridges, subways and airports to better survive a seismic event.

Figure 2:
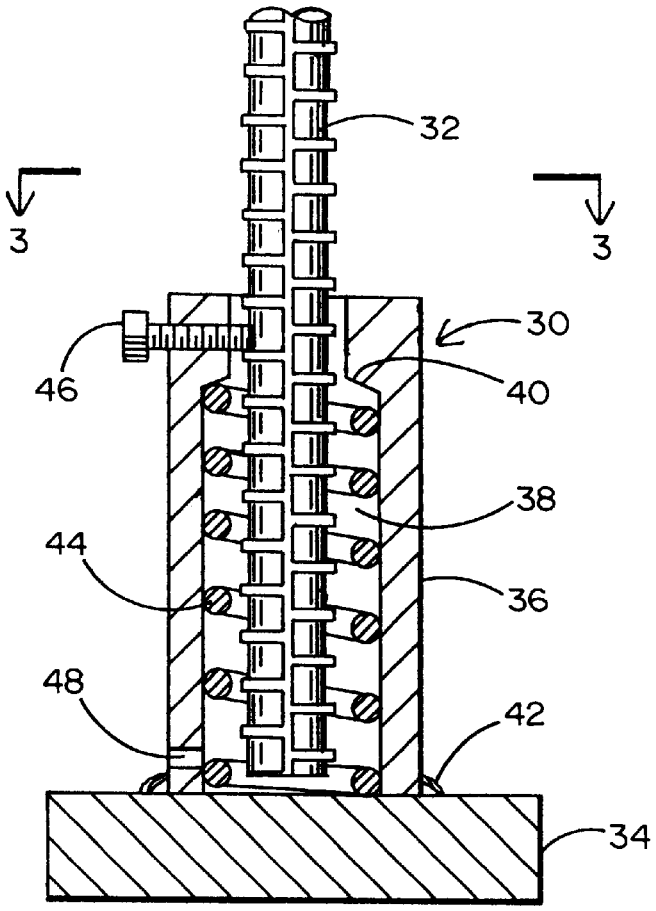
FIG. 2 shows a pipe coupler according to a second embodiment of this invention for splicing a single steel reinforcement bar to a flat steel plate to form a T-headed bar configuration.
Figure 3:
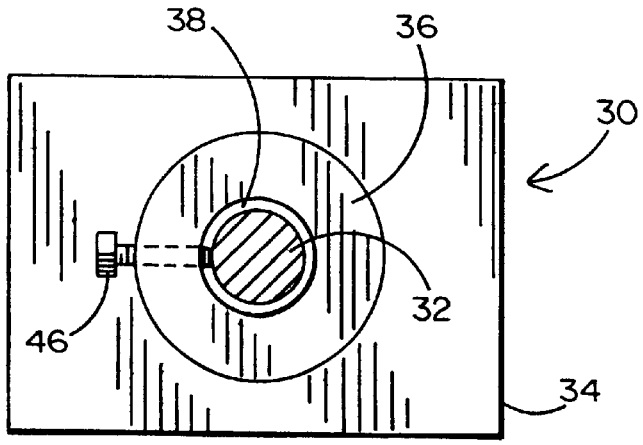
FIG. 3 is a cross-section taken along lines 3—3 of FIG. 2.

FIGS. 2 and 3 of the drawings show a second embodiment for a high strength pipe coupler 30 of this invention. While the pipe coupler 1 of FIGS. 1 and 1*a* is used to splice a pair of reinforcement bars 3 and 5 in spaced axial alignment, one above the other, FIGS. 2 and 3 show a coupler 30 for surrounding one end of a single reinforcement bar 32 that is to be mechanically coupled to a flat anchor in the form of a steel plate 34. The pipe coupler 30 of this embodiment includes a cylindrical steel sleeve or tube 36. The coupler tube 36 has a length that is equal to about five times the diameter of the single reinforcement bar 32 and about six to seven times the thickness of plate 34. The diameter of the coupler tube 36 must be sufficiently large to establish a small bore 38 between the reinforcement bar 32 and the inner wall of coupler tube 36. The coupler tube 36 includes a seat 40 that extends from the top end thereof radially inward of the bore 38.

The coupler tube 36 is preferably affixed to the flat steel plate 34 by means of a friction weld 42. However, the tube 36 and plate 34 may also be forged or cast together as a single piece. Disposed within the bore 38 of the coupler tube 36 and surrounding the free end of the reinforcement bar 32 received therein is a spirally wound reinforcing spring 44. The top end of reinforcing spring 44 is received against the inwardly projecting seat 40 at the top end of the coupler tube 36. As in the pipe coupler 1 of FIGS. 1 and 1*a*, the spirally wound spring 44 of the pipe coupler 30 of FIGS. 2 and 3 rests freely within the bore 38 between reinforcement bar 32 and the coupler tube 36. The characteristics and advantages of the spirally round reinforcing spring 44 are identical to those described above when referring to the reinforcing spring 12 of coupler 1 and, for the purpose of convenience, will not be described again.

During assembly of the pipe coupler 30, the reinforcement bar 32 is first inserted through the top of coupler tube 36 so as to rest against the flat plate 34. The reinforcement bar 32 is then lifted a short distance off the plate 34, whereby the bar is spaced upwardly from the plate. To preserve the aforementioned spacing, a set screw 46 is moved into locking engaging with the reinforcement bar 32 through a screw hole formed at the top end of the coupler tube 36 and through seat 40. Once the reinforcement bar 32 is secured within the tube 36 so as to lie in axial spaced alignment with the plate 34 lying thereunder, the bore 38 of pipe coupler 30 is loaded with a solidifier (not shown), such as the same epoxy or cement based grout that is designated by reference numeral 22 in FIG. 1*a*. The pipe coupler 30 is loaded with the solidifier via an inlet opening 48 through the bottom of coupler tube 36. As the solidifier cures, the set screw 46 can be removed from the coupler tube 36.

When the solidifier fully hardens to form a solid core, the embedded reinforcement bar 32 will be coupled to the flat plate 34, whereby pipe coupler 30 creates a reliable high performance mechanical splice to form a T-headed bar configuration. Moreover, the flat plate 34 serves as an enlarged anchor to be embedded within a concrete structure to help resist the effects of a seismic event. The pipe coupler 30 of FIGS. 2 and 3 may be assembled either in the field or in a workshop to be subsequently moved to the field.

Each of the high strength reinforcement pipe couplers 1 and 30 disclosed herein includes a relatively short coupler sleeve or tube 10 and 36 which correspondingly reduces the amount of epoxy or cement grout that is required to produce the solidifier core. In this same regard, the reinforcement bars received by the coupler tubes require no elongated heads to enable the diameters of the coupler tubes 10 and 36 to be minimized. The coupler tubes 10 and 36 need not be threaded and do not require threaded inserts to support the reinforcement bars in the manner of my U.S. Pat. No. 6,192,647. By virtue of the foregoing, the pipe couplers 1 and 30 may be more efficiently manufactured so as to advantageously reduce the cost and production time associated therewith.

I claim:

1. A mechanical coupler to splice together opposing ends of first and second steel reinforcement bars that are positioned in spaced axial alignment with one another, said mechanical coupler including a hollow tubular body within which the opposing ends of said first and second reinforcement bars are received, a spirally wound wire detached from and extending longitudinally through said tubular body in spaced coaxial alignment with said first and second reinforcement bars so as to surround the opposing ends of said first and second reinforcement bars to be spliced together, and a solid core formed within said tubular body within which said spirally wound wire and the opposing ends of said first and second reinforcement bars are embedded and anchored, said spirally wound wire providing reinforcement to prevent said solid core from being pulled outwardly from said tubular body in response to a seismic event.

2. The mechanical coupler recited in claim 1, wherein said tubular body includes a seat extending radially inward from each of the opposite ends thereof, said spirally wound wire extending longitudinally through said tubular body between the seats at the opposite ends of said tubular body.

3. The mechanical coupler recited in claim 1, wherein said spirally wound wire has a flexible spring characteristic.

4. The mechanical coupler recited in claim 1, also including a stopper pin removably received through an inlet opening in said tubular body and positioned between the opposing ends of said first and second reinforcement bars to maintain the spaced alignment thereof, said stopper pin being removed from said tubular body prior to the formation of said solid core within said tubular body.

5. The mechanical coupler recited in claim 4, also including first and second set screws moved through respective openings in said tubular body and into locking engagement with said first and second reinforcement bars to preserve the spaced axial alignment thereof, said removable stopper pin being removed from said tubular body via said inlet opening following the locking engagement between said first and second reinforcement bars and said first and second set screws.

6. The mechanical coupler recited in claim 5, wherein said solid core comprises one of a cement or epoxy solidifier material with which said tubular body is filled via said inlet opening after said stopper pin has first been removed from said tubular body.

7. A mechanical coupler to splice a steel reinforcement bar to a flat steel plate, said mechanical coupler including a hollow tubular body within which to receive said reinforcement bar, a spirally wound wire detached from and extending longitudinally through said tubular body in spaced coaxial alignment with said reinforcement bar within said tubular body, and a solid core formed within said tubular body within which said spirally wound spring and said reinforcement bar are embedded, whereby said reinforcement bar and said flat plate are spliced together in a T-shaped coupler configuration, and spirally wound wire preventing said solid core from being pulled outwardly from said tubular body in response to a seismic event.

8. The mechanical coupler recited in claim 7, said tubular body includes a seat extending radially inward from a top end thereof, said spirally wound wire extending through said tubular body between the seat at the top end of said tubular body and said flat plate.

9. The mechanical coupler recited in claim 7, said spirally wound wire has a flexible spring characteristic.

10. The mechanical coupler recited in claim 7, also including a set screw removably received through said tubular body to engage and hold said reinforcement bar in spaced alignment with said flat plate, said set screw being removed from said tubular body during the formation of said solid core within said tubular body.

11. The mechanical coupler recited in claim 7, also including an inlet opening formed in said tubular body, said solid core comprising one of a cement or epoxy solidifier material with which said tubular body is filled by way of said inlet opening.

12. The mechanical coupler recited in claim 7, wherein said tubular body is affixed to said flat plate by means of a weld.

* * * * *